US007300054B2

(12) United States Patent
Suga et al.

(10) Patent No.: US 7,300,054 B2
(45) Date of Patent: Nov. 27, 2007

(54) SHEET CONVEYING APPARATUS, IMAGE FORMING APPARATUS AND IMAGE READING APPARATUS

(75) Inventors: Takeshi Suga, Ibaraki (JP); Masafumi Takagi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 498 days.

(21) Appl. No.: 10/893,349

(22) Filed: Jul. 19, 2004

(65) Prior Publication Data

US 2005/0035528 A1 Feb. 17, 2005

(30) Foreign Application Priority Data

Jul. 23, 2003 (JP) ..... 2003-200734

(51) Int. Cl.
*B65H 7/10* (2006.01)
*B65H 7/08* (2006.01)

(52) U.S. Cl. ..... 271/228

(58) Field of Classification Search ..... 271/227, 271/226, 242, 243, 248, 249, 250, 252, 253, 271/254, 255, 228; 400/630, 633, 633.1, 400/633.2

See application file for complete search history.

(56) References Cited

U.S. PATENT DOCUMENTS 5,157,449 A * 10/1992 Matsuno et al. ..... 399/395
5,678,127 A 10/1997 Suga ..... 399/45
5,697,609 A * 12/1997 Williams et al. ..... 271/228
6,059,285 A 5/2000 Suga et al. ..... 271/228
6,260,840 B1 7/2001 Suga et al. ..... 271/10.12
6,634,521 B1 * 10/2003 Hwang ..... 221/228
2004/0081496 A1 4/2004 Endo et al. ..... 399/390
2006/0285903 A1 * 12/2006 Yamane et al. ..... 399/394

FOREIGN PATENT DOCUMENTS

JP 10-67448 3/1998
JP 10067448 * 10/1998
JP 11-124254 5/1999
JP 2005035709 * 2/2005

* cited by examiner

*Primary Examiner*—Patrick Mackey
*Assistant Examiner*—Jeremy Severson
(74) *Attorney, Agent, or Firm*—Fitzpatrick, Cella, Harper & Scinto

(57) ABSTRACT

A sheet conveying apparatus for conveying a sheet along a sheet path, has a skew detecting unit for detecting the skew of the sheet being conveyed, a skew correcting unit rotatable in a direction to correct the skew of the sheet in a state nipping the sheet in its skew state, on the basis of a detection signal from the skew detecting unit, a position correcting unit for moving the skew correcting unit in a direction intersecting with the sheet conveying direction, and a controller for controlling so as to move the skew correcting unit in the direction intersecting with the sheet conveying direction by the position correcting unit while conveying the sheet by the skew correcting unit, in order to convey the sheet in a state coincident with the sheet conveying direction when the skew correcting unit is rotated to correct the skew of the sheet and convey the sheet in the rotated state.

7 Claims, 14 Drawing Sheets

SHEET CONVEYING APPARATUS, IMAGE FORMING APPARATUS AND IMAGE READING APPARATUS

This application claims priority from Japanese Patent Application No. 2003-200734 filed Jul. 23, 2003, which is hereby incorporated by reference.

BACKGROUND OF THE INVENTION

1. Field of the Invention

This invention relates to a sheet conveying apparatus for conveying a sheet to the image forming portion of an image forming apparatus, and particularly to a construction for correcting the skew of a sheet such as recording paper or an original.

2. Description of the Related Art

Heretofore, image forming apparatus and image reading apparatuses such as a copying machine, a printer, a facsimile apparatus and a scanner have been provided with sheet conveying apparatuses for conveying a sheet such as recording paper or an original to an image forming portion or an image reading portion. Some of such sheet conveying apparatus are provided with correcting means for effecting the skew conveying correction of the sheet or the positional deviation correction of the sheet to adjust the posture and position of the sheet before the sheet is conveyed to the image forming portion or the image reading portion.

A correcting method by such correcting means uses a pair of registration rollers, and for example, in the case of an image forming apparatus, the so-called loop registration method of ramming the leading edge of a sheet against the nip between the pair of registration rollers being at a halt to thereby form a flexure in the sheet, causing the leading edge of the sheet to be along the nip by the elasticity of the sheet to thereby effect the correction of skew conveying, thereafter rotating the pair of registration rollers at predetermined timing, and synchronize the sheet with an image has become a mainstream.

In such a loop registration method, however, a loop space for forming a loop becomes always necessary, and this has made the apparatus bulky. Also, when the loop space cannot be sufficiently secured, there is the problem that jam due to buckling occurs particularly to a sheet such as thin paper of weak rigidity, or a sound (so-called loop sound) is produced when the sheet is caused to abut against the pair of registration rollers.

Further, there is the problem that the skew conveying correcting capability is changed by the degree of rigidity of the sheet. Specifically, in the case of thin paper low in rigidity, the abutting pressure when the leading edge of the sheet abuts against the registration roller nip is deficient and the leading edge of the sheet may sometimes not sufficiently abut against the pair of registration rollers, and in such case, skew conveying correction cannot be completely effected.

Also, in the case of thick paper or the like high in rigidity, there is the inconvenience that by the shock with which the sheet abuts against the nip between the pair of registration rollers, the sheet goes through the nip between the pair of registration rollers, and if in order to prevent this, an attempt is made to give a load or the like to the pair of registration rollers, for example, by a brake member, it will result in an increase in the cost of the product.

Furthermore, when the leading edge of the sheet is curled or broken, the leading edge of the sheet cannot be accurately along the nip portion of the pair of registration rollers, and this also results in the problem that skew conveying correction cannot be accurately effected and printing accuracy lowers.

On the hand in recent years, the image forming apparatuses and the image reading apparatuses are adapted, by digitizing, to once be capable of reading an original, and thereafter electrically encoding the image information thereof and storing it in a memory. During image forming, they have been designed to read out the information in the memory, and form an image corresponding to the image formation of the original on a photosensitive member by a laser beam or an exposing apparatus such as an LED array and therefore, even in the copying of a plurality of sheets, the mechanical movement of an optical apparatus or the like becomes unnecessary.

Thereby, the inter-sheet spacing which is the interval between a sheet and a sheet can be shortened, and it has become possible to treat many sheets within a short time. As a result, for example, in the case of the image forming apparatus, it has become possible to achieve a substantial improvement in the image forming speed without increasing the process speed during image forming.

However, when as the sheet conveying apparatus, use is made of one adopting the already described loop registration method, design is made such that a sheet is once stopped to form a loop and therefore, the inter-sheet spacing is necessarily determined, and this comes to greatly affect an improvement in the image forming speed (productivity).

So, in order to overcome such an inconvenience, Japanese Patent Application Laid-Open No. Hei 10-067448 proposes a sheet conveying apparatus adopting a registration method adapted to be capable of automatically correct the skew conveying of a sheet.

This sheet conveying apparatus is provided with a pair of conveying rollers (registration rollers) for nipping and conveying a sheet therebetween, a sensor for detecting the skew amount of the sheet provided downstream of the conveying rollers with respect to the conveying direction thereof, and conveying roller inclination correcting means for displacing the conveying rollers so as to be inclined in a direction intersecting with a sheet conveying direction, and when the skew conveying of the sheet is to be corrected, it is adapted to displace the conveying rollers in accordance with the skew of the sheet on the basis of the information from the skew amount detecting sensor to thereby correct the skew conveying of the sheet.

However, in such a conventional-sheet conveying apparatus for displacing the conveying rollers to thereby correct the skew conveying of the sheet, the conveying rollers (registration rollers) are in a posture inclined with respect to the original sheet conveying direction at a point of time whereat the skew conveying correction of the sheet has been effected and therefore, if in that state, the sheet is conveyed, the sheet will be fed in a skew direction with respect to the original sheet conveying direction.

When so-called skew feeding in which the sheet S is thus fed in the skew direction occurs, there is the inconvenience that if this sheet conveying apparatus is applied, for example, to an image forming apparatus, an image will be obliquely transferred to the sheet and printing accuracy will become remarkably inferior.

Against such inconvenience, design is made such that (1) the pressure contact (nip) between the pair of conveying rollers is released at a point of time whereat the sheet has reached a post-step and the sheet has been held, or (2) the rotational speed of the pair of conveying rollers is increased at the point of time whereat the sheet has reached the post-step and the sheet has been held, and the loop (flexure) of the sheet is formed between the post-step and the pair of conveying rollers to thereby absorb the skew feeding by the loop.

In the case of item (1) above, however, there is the problem that a mechanism for releasing the nip between the pair of conveying rollers becomes necessary and the cost of the product is greatly increased, or the vibration when the nip is released adversely affects the post-step. Also, there is left the problem that if the sheet is held at the post-step, the nip must be released in a moment and it is very difficult to take the timing therefor.

Also, in the case of item (2) above, there is the problem that when the distance from the conveying roller portion to the post-step portion is short, the absorption of the skew feeding by the loop is very difficult and the sheet becomes wrinkled. Also, when the rigidity of the sheet is high like thick paper or the like, the loop is not formed and the absorption of the skew feeding by the loop is impossible.

SUMMARY OF THE INVENTION

So, the present invention has been made in view of such a situation, and an object thereof is to provide a sheet conveying apparatus, an image forming apparatus and an image reading apparatus which can improve the correction accuracy of a sheet, and also can prevent the skew feeding of the sheet.

The present invention provides a sheet conveying apparatus for conveying a sheet by sheet conveying means disposed along a sheet conveying path, having:

skew detecting means for detecting the skew of the sheet being conveyed with respect to a sheet conveying direction;

skew correcting means rotatable in a direction to correct the skew of the sheet in a state nipping the sheet in its skew state, on the basis of a detection signal from the skew detecting means;

position correction means for moving the skew correcting means in a direction intersecting with the sheet conveying direction; and control means for controlling so as to move the skew correcting means in the direction intersecting with the sheet conveying direction by the position correcting means while correcting the skew of the sheet by the skew correcting means.

Also, the present invention provides a sheet conveying apparatus for conveying a sheet by sheet conveying means disposed along a sheet conveying path, having:

position detecting means for detecting the position of a side edge of the sheet conveyed along the sheet conveying path in a direction orthogonal to a sheet conveying direction;

calculating means for calculating the skew of the sheet on the basis of side edge position information from the position detecting means;

skew correcting means rotatable in a direction to correct the skew of the sheet in a state nipping the sheet in its skew state on the basis of the result of calculation from the calculating means;

position correcting means for moving the skew correcting means in a direction intersecting with the sheet conveying direction; and control means for controlling so as to move the skew correcting means in the direction intersecting with the sheet conveying direction by the position correcting means while correcting the skew of the sheet by the skew correcting means.

DESCRIPTION OF THE PREFERRED EMBODIMENTS

Some embodiments of the present invention will hereinafter be described in detail with reference to the drawings.

Figure 1:
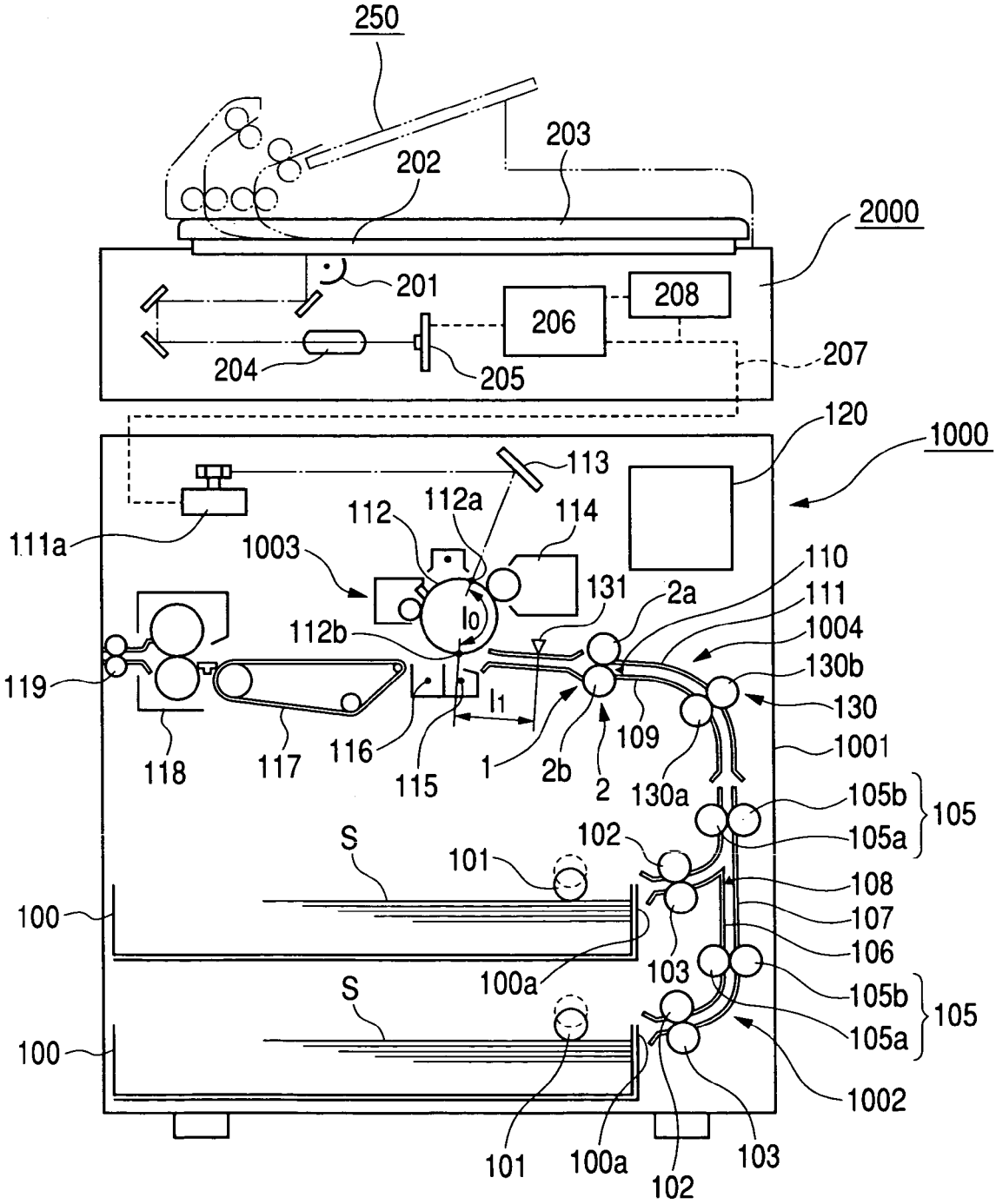
FIG. 1 is a cross-sectional view of the printer which is an example of an image forming apparatus provided with a sheet conveying apparatus according to a first embodiment of the present invention.

FIG. 1 is a cross-sectional view of a printer which is an example of an image forming apparatus provided with a sheet conveying apparatus according to a first embodiment of the present invention.

In FIG. 1, the reference numeral 1000 designates the printer, and this printer 1000 is provided with a printer main body 1001 and a scanner 2000 disposed on the upper surface of the printer main body 1001.

The scanner 2000 for reading an original is provided with a scanning optical system light source 201, platen glass 202, an openable and closable original pressure plate 203, a lens 204, a light receiving element (photoelectric conversion) 205, an image processing portion 206, a memory portion 208 for storing therein an image processing signal processed by the image processing portion 206, etc.

Design is made such that when the original is to be read light is applied to the original, not shown, placed on the platen glass 202 by the scanning optical system light source 201 to thereby read the original. The image of the read original is processed by the image processing portion 206, and thereafter is converted into an electrically encoded electrical signal 207, which is then transmitted to a laser scanner 111*a* which is image forming means. The image information processed and encoded by the image processing portion 206 can also be once stored in the memory portion 208 and be transmitted to the laser scanner 111*a* as required, by a signal from a controller 120.

The printer main body 1001 is provided with a sheet feeding apparatus 1002 for feeding a sheet S, a sheet conveying apparatus for conveying the sheet S fed by the sheet feeding apparatus 1002 to an image forming portion 1003, the controller 120 which is control means for controlling the printer 1000, etc.

The sheet feeding apparatus 1002 is provided with a cassette 100, a pickup roller 101, and a separating portion comprising a feed roller 102 and a retard roller 103, and design is made such that the sheets S in the cassette 100 are separated and fed one by one by the action of the pickup roller 101 moved up and down rotated at predetermined timing, and the separating portion.

The sheet conveying apparatus 1004 is provided with a pair of conveying rollers 105, and a skew correction roller portion 1 having a pair of ante-skew correction rollers 130 and a pair of skew correction rollers 2, and is designed such that the sheet S fed from the sheet feeding apparatus 1002 is passed through a sheet conveying path 108 comprised of guide plates 106 and 107 by the pair of conveying rollers 105, and thereafter is delivered to a sheet conveying path 110 comprised of guide plates 106 and 107, and then is directed to the skew correction roller portion 1. In this skew correction roller portion 1, as will be described later, the sheet S has its skew conveying and positional deviation corrected, and thereafter is conveyed to the image forming portion 1003.

The image forming portion 1003 is provided with a photosensitive drum 112, a laser scanner 111*a*, a developing device 114, a transfer charging device 115, a separation charging device 116, etc, and is designed such that during image forming, a laser beam from the laser scanner 111*a* is turned back by a mirror 113 and is applied to an exposure position 112*a* on the photosensitive drum being rotated in a clockwise direction, whereby a latent image is formed on the photosensitive drum and further, the latent image thus formed on the photosensitive drum is thereafter visualized as a toner image by the developing device 114.

Thereafter, the toner image on the photosensitive drum is transferred to the sheet S by a transfer charging device 115 in a transferring portion 112*b*. Further, the sheet S to which the toner image has been thus transferred is electrostatically separated from the photosensitive drum 112 by the separation charging device 116, and thereafter is conveyed to a fixing apparatus 118 by a conveying belt 117 and is subjected to the fixing of the toner image, and thereafter is discharged by discharge rollers 119.

In FIG. 1, the reference numeral 131 designates an exposing start sensor for detecting the sheet S passed between the pair of skew correction rollers 2, and when this exposing start sensor 131 detects the sheet S passed between the pair of skew correction rollers 2, the application of a laser beam by the laser scanner 111*a* is started.

The distance 11 from the exposing start sensor 131 to the transferring portion 112*b* is equal to the distance from the laser beam application position 112*a* of the photosensitive drum 112 to the transferring portion 112*b*, whereby it is possible to synchronize the sheet S and the leading edge position of the image on the photosensitive drum 112.

In the present embodiment, the printer main body 1001 and the scanner 2000 are discrete from each other, but in some cases, the printer main body 1001 and the scanner 2000 are integral with each other. Also, irrespective of whether the printer main body 1001 is discrete or integral with the scanner 2000, if the processing signal of the scanner 2000 is inputted to the laser scanner 111*a*, the printer main body 1001 functions as a copying machine, and if the transmitted signal of a facsimile apparatus is inputted to the laser scanner 111*a*, the printer main body 1001 functions as a facsimile apparatus. Further, if the output signal of a personal computer is inputted to the laser scanner 111*a*, the printer main body functions also as a printer.

If conversely, the processing signal of the image processing portion 206 of the scanner 2000 is transmitted to other facsimile apparatus, the printer main body functions as a facsimile apparatus. Also, if in the scanner 2000, an automatic original feeding apparatus 250 as indicated by dots-and-dash line is mounted in place of the pressure plate 203, an original can also be automatically read.

Figure 2:
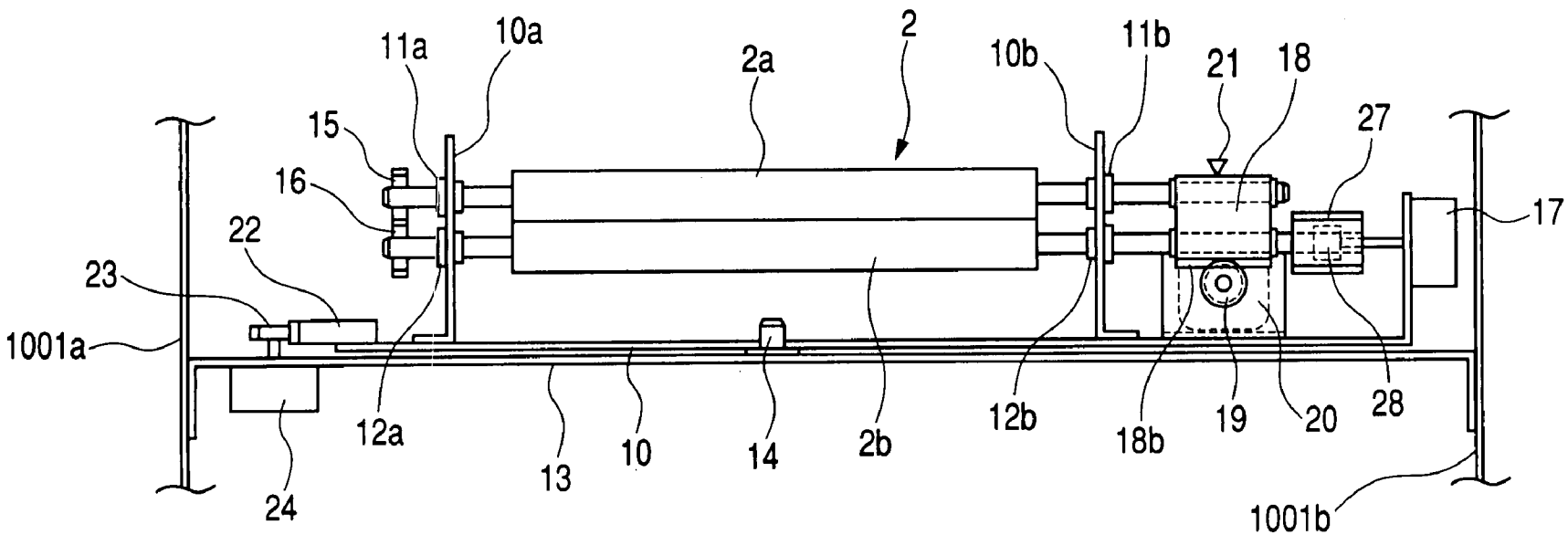
FIG. 2 is a side view of the skew correction roller portion of the sheet conveying apparatus.
Figure 3:
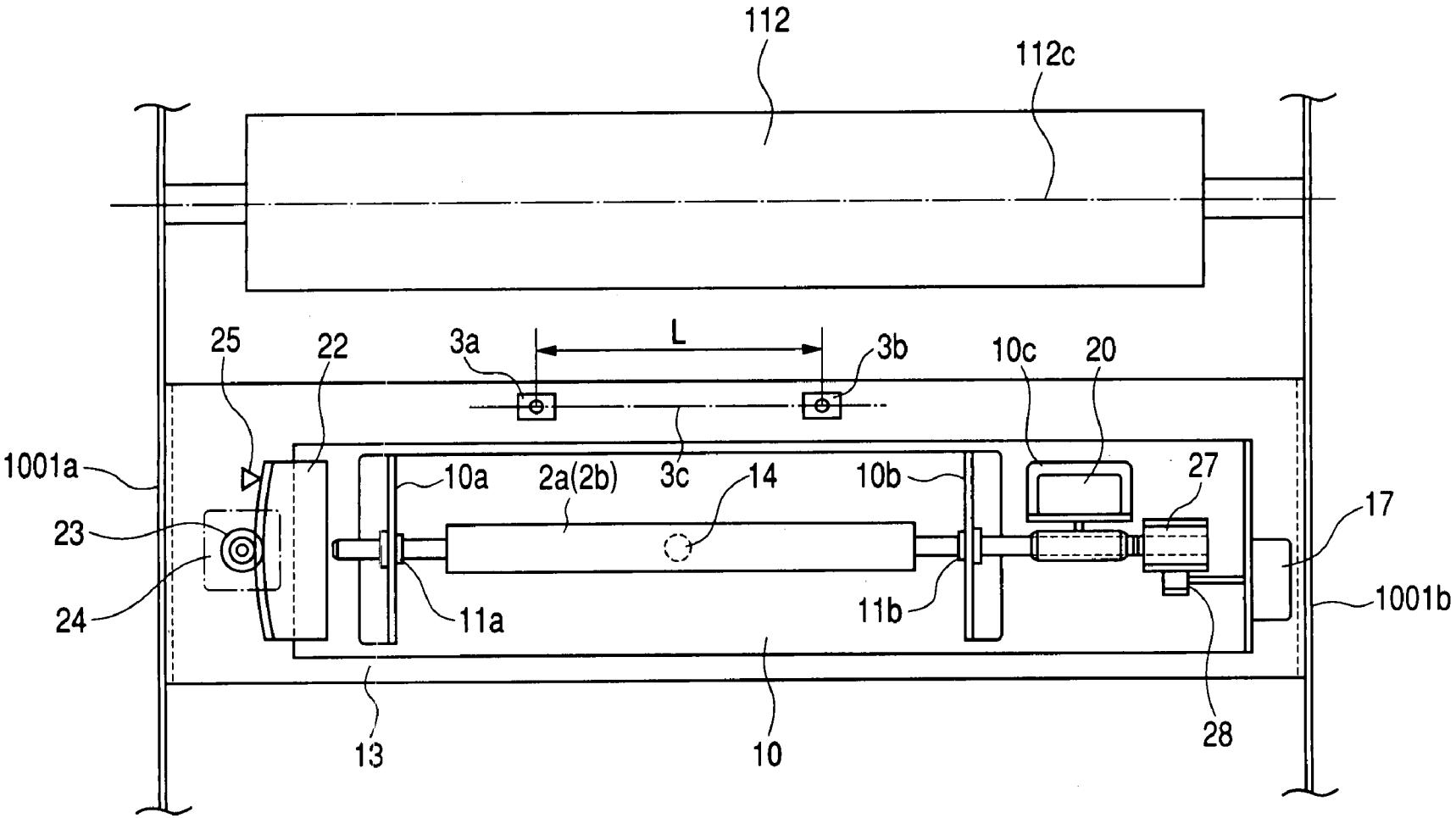
FIG. 3 is a plan view of the skew correction roller portion of the sheet conveying apparatus.

FIG. 2 is a side view of the skew correction roller portion 1, and FIG. 3 is a plan view thereof.

As shown in FIGS. 2 and 3, the pair of skew correction rollers 2 which are skew correcting means are comprised of two skew correction rollers 2*a* and 2*b*, and these skew correction rollers 2*a* and 2*b* are rotatably journalled by bearings 11*a*, 11*b* and 12*a*, 12*b*, respectively, fixed to side plates 10*a* and 10*b* vertically provided on a frame 10.

The upper skew correction roller 2*a* is pressed against the lower skew correction roller 2*b* by a pressure spring, not shown.

Also, the skew correction rollers 2*a* and 2*b* have gears 15 and 16, respectively, mounted on one side thereof, and the pair of skew correction rollers 2*a* and 2*b* are designed to be rotated in synchronism with each other by these gears 15 and 16.

Further, a drive input gear 27 is fixed to the shaft end of the lower skew correction roller 2*b*, and a gear 28 fixed to the output shaft of a skew correction motor 17 is in mesh engagement with the drive input gear 27, whereby when the skew correction motor 17 is driven, the pair of skew correction rollers 2 are rotated.

Further, on the skew correction motor side which is one end side of the pair of skew correction rollers 2, there is provided a connecting member 18 for connecting the skew correction rollers 2*a* and 2*b* together and regulating the axial movement of the skew correction rollers 2*a* and 2*b*. This connecting member 18 rotatably journals the respective skew correction rollers 2*a* and 2*b*, and has a rack gear portion 18*b* provided on the bottom surface thereof, and a pinion gear 19 fixed to the output shaft of a lateral moving motor 20 is in mesh engagement with the rack gear portion 18*b*.

Thus, when for example, the pinion gear 19 is rotated in a clockwise direction, the connecting member 18 is moved rightwardly as viewed in FIG. 2, and therewith, the pair of skew correction rollers 2 are moved in a thrust direction, i.e., a direction intersecting with a conveying direction. That is, design is made such that by the lateral moving motor 20 which is position correcting means being driven, the pair of skew correction rollers 2 can be moved in the thrust direction (the axial direction of the pair of skew correction rollers).

In FIG. 2, the reference numeral 21 denotes a first home position sensor, and design is made such that a first home position of the pair of skew correction rollers 2 in the thrust direction can be detected by this first home position sensor 21.

On the other hand, the frame 10 is mounted for pivotal movement about a pivot shaft 14 provided on a stay 13 fixed between the front side plate 1001*a* and rear side plate 1002*b* of the printer main body 1001. This pivot shaft 14 becomes the center of pivotal movement during the correction of the inclination of the pair of skew correction rollers 2 which will be described later, and also becomes the reference position of the pair of skew correction rollers 2 on the axis thereof.

Also, a gear 22 is fixed to the front side plate of the frame 10, and the gear 22 is in mesh engagement with a rack gear 23 fixed to the output shaft of a rotating motor 24 mounted on the stay 13.

When this rotating motor 24 is rotated and for example in FIG. 3, the rack gear 23 is rotated in the clockwise direction, all of the frame 10 and members mounted on the frame 10 including the pair of skew correction rollers 2, the skew correction motor 17, etc. provided on the frame 10 may be pivotally moved (rotated) in a counter-clockwise direction about the pivot shaft 14.

That is, design is made such that by the rotation of the rotating motor 24, the pair of skew correction rollers 2 can be displaced (rotated) so as to be inclined with respect to the thrust direction. In FIG. 3, the reference numeral 25 designates a second home position sensor provided on the stay 13, and design is made such that a second position in a rotating (pivotal movement) direction in which the nip line of the pair of skew correction rollers 2 becomes parallel to the rotation center axis 112*c* of the photosensitive drum 112 is detected by this second home position sensor 25.

In FIG. 3, the reference characters 3*a* and 3*b* denote skew conveying detection sensors which are skew detecting means for detecting the skew of the leading edge of the sheet S, and these skew conveying detection sensors 3*a* and 3*b* are disposed downstream of the pair of skew correction rollers 2 with respect to the conveying direction and at a predetermined interval L in a direction orthogonal to the sheet conveying direction. The center line 3*c* linking the skew conveying detection sensors 3*a* and 3*b* together is disposed so as to be parallel to the axis 112*c* of the photosensitive drum provided on the downstream side with respect to the conveying direction.

Figure 4:
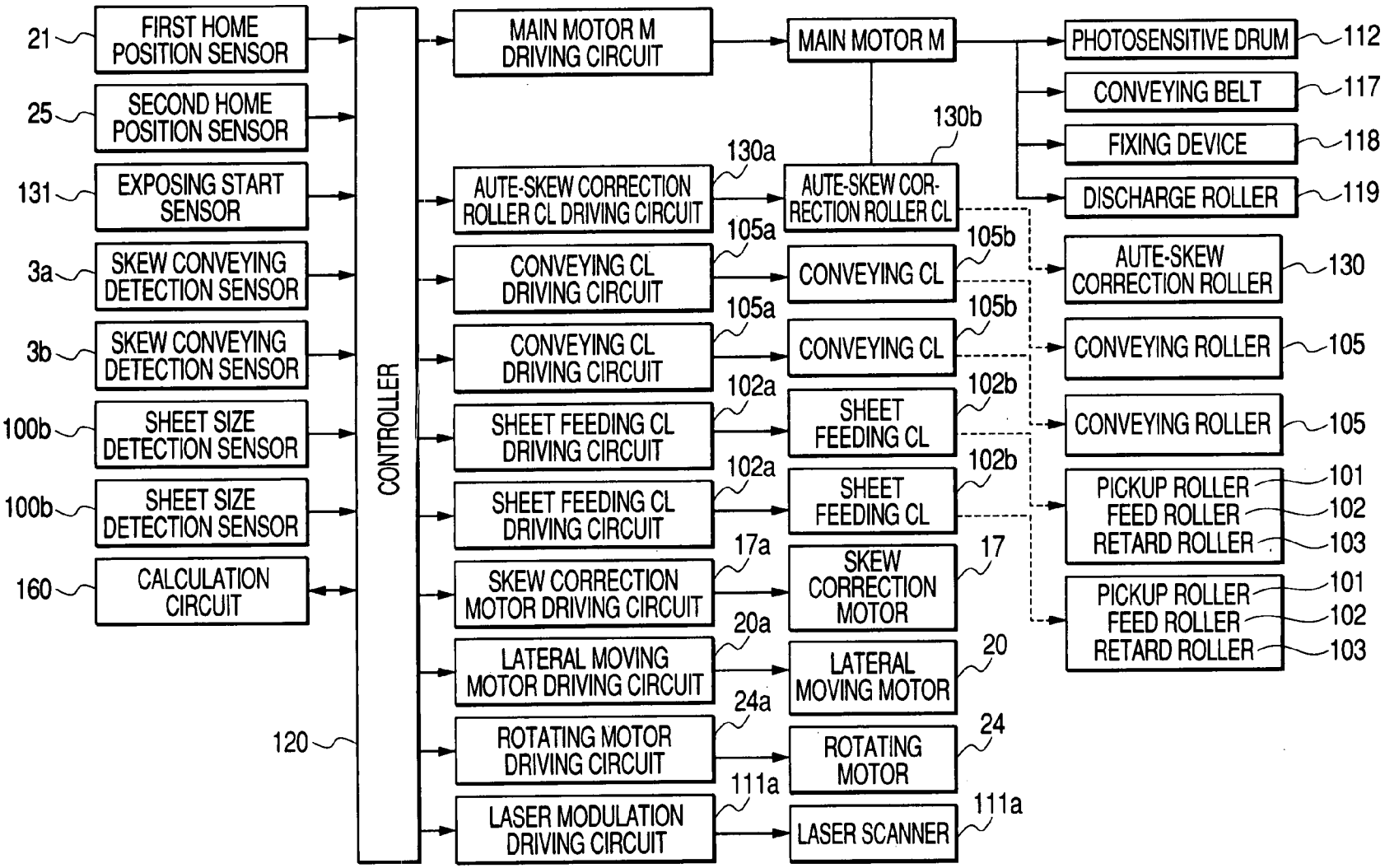
FIG. 4 is a control block diagram of the printer.
Figure 5:
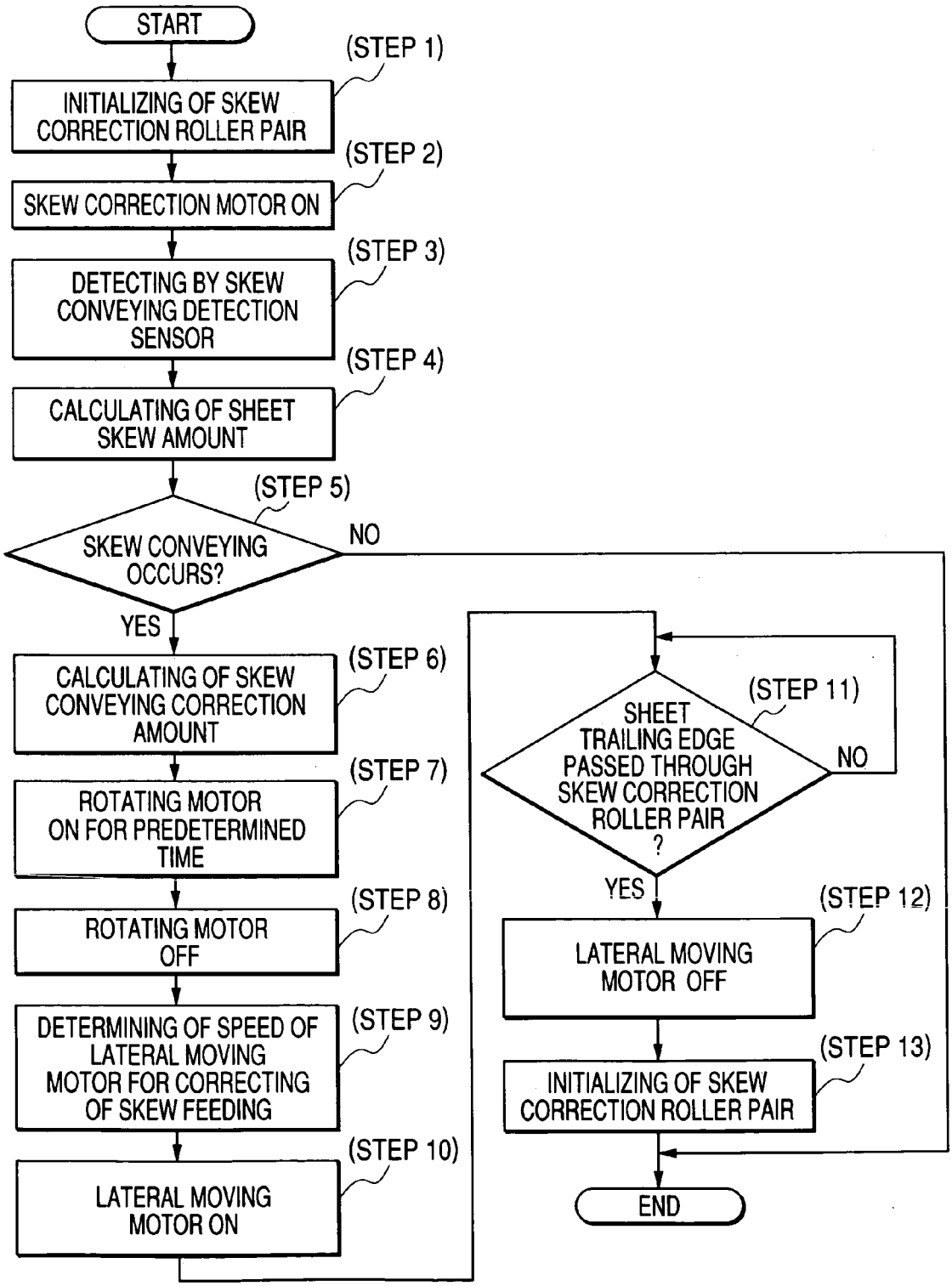
FIG. 5 is a flow chart illustrating the skew conveying correcting operation of the sheet conveying apparatus.

FIG. 4 is a control block diagram of the printer 1000 provided with such a sheet conveying apparatus 1004, etc., and as shown in FIG. 4, the aforedescribed photosensitive drum 112, conveying belt 117, fixing device 118 and sheet discharging rollers 119 are directly connected to a main motor M, and are rotatable in synchronism with the main motor M. Also, the aforedescribed pickup roller 101, feed roller 102, retard roller 103, conveying rollers 105 and the pair of ante-skew correction rollers 130 are designed to receive a driving force from the main motor M and be drive-controlled by clutches 102*b*, 105*b* and 130*b* ON/OFF controlled by a signal from a controller 120 through respective driving circuits 102*a*, 105*a* and 130*a*.

Also, design is made such that sheet size detection signals from sheet size detection sensors 100*b* and 100*b* installed in the sheet feeding cassette 100, detection signals from the skew conveying detection sensors 3*a* and 3*b*, or signals from the first home position sensor 21 and the second home position sensor 25 are inputted to the controller 120 which is control means. In the controller 120, the skew amount of the sheet S is calculated by a calculating circuit 160 on the basis, for example, of the detection signals from the skew conveying detecting sensors 3*a* and 3*b*.

Further, the controller 120 is adapted to output a necessary control signal based on the result of detection to driving circuits 19*a*, 20*a*, 24*a* and 111*a*, and drive the skew correction motor 17, the lateral moving motor 20, the rotating motor 24 and the laser scanner 111*a* by a predetermined amount or for a predetermined amount through these driving circuits 17*a*, 20*a*, 24*a* and 111*a*.

The skew conveying correcting operation of the printer 1000 (sheet conveying apparatus 1004) of such a construction will now be described with reference the flow chart of FIG. 5 and FIGS. 6A to 6C and 7.

First, when the first button, not shown, of the printer 1000 is depressed, the lateral moving motor 20 and the rotating motor 24 are driven and the operation of initializing the position of the pair of skew correction rollers 2 in the rotating direction and the thrust direction thereof is performed by the first home position sensor 21 and the second home position sensor 25 (step 1).

Figure 6A:
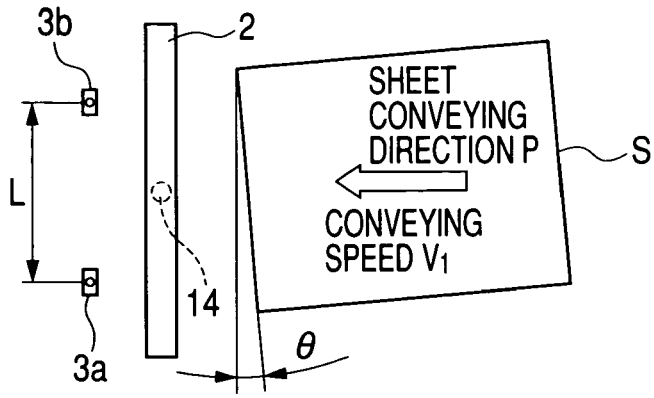
FIGS. 6A, 6B, 6C and 6D are first views illustrating the skew conveying correcting operation of the sheet conveying apparatus.
Figure 6B:
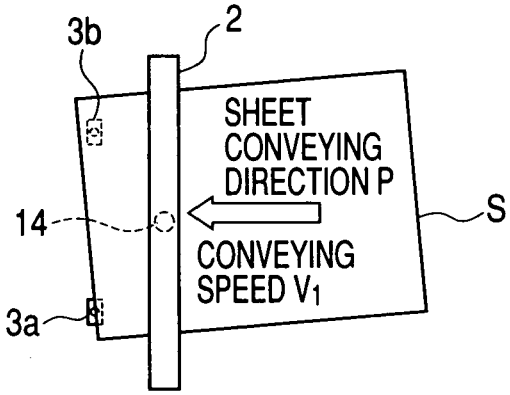

After this initializing operation, the skew correction motor 17 is driven (ON) and the pair of skew correction rollers 2 start to be rotated (step 2). Here, when a sheet S skew-conveyed at an angle θ with respect to the sheet conveying direction P as shown in FIG. 6A is conveyed to the pair of skew correction rollers 2 which have thus started to be rotated, this sheet S will soon come into and be nipped by the nip portion of the pair of skew correction rollers 2.

Further, thereafter, the sheet S nipped between the pair of skew correction rollers 2 is conveyed forward along the sheet conveying direction P while remaining skew, whereby it is detected by the skew conveying detection sensors 3*a* and 3*b* disposed downstream of the pair of skew correction rollers 2 (step 3).

Here, detection signals from these skew conveying detection sensors 3*a* and 3*b* are inputted to the controller 120, whereafter the point of time at which the leading edge of the sheet passes and the skew amount of the sheet S nipped between the pair of skew correction rollers 2 are calculated by the calculating circuit 160 (step 4).

Next, the controller 120 judges the presence or absence of the skew conveying of the sheet S from the result of this calculation (step 5), and if the skew conveying of the sheet S is absent (N at the step 5), the controller does not perform a correcting operation, but if the skew conveying of the sheet S is present (Y at the step 5), the controller calculates a skew conveying correction amount therefor, i.e., the drive amount of the rotating motor 24 (step 6).

Figure 6C:
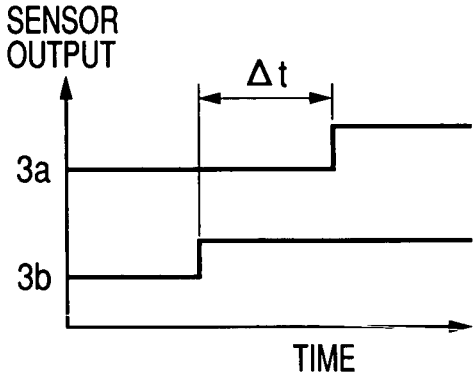
Figure 6D:
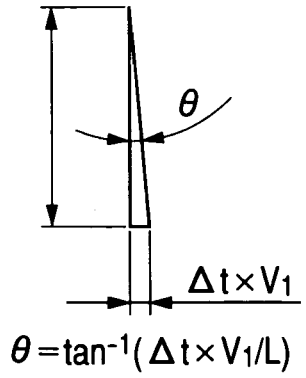

Here, when for example, the difference between the detection timing of the skew conveying detection sensor 3*a* and the detection timing of the skew conveying detection sensor 3*b* is Δt as shown in FIG. 6C, assuming that the conveying speed of the sheet S is V1 and the pitch (inter-sensor distance) of the skew conveying detection sensor 3*a* and 3*b* is L, the skew amount of the sheet S can be calculated by the following expression 1 as is apparent from FIG. 6D.

$$\theta=\tan^{-1}(\Delta t\times V1/L) \qquad \text{(expression 1)}$$

Figure 7A:
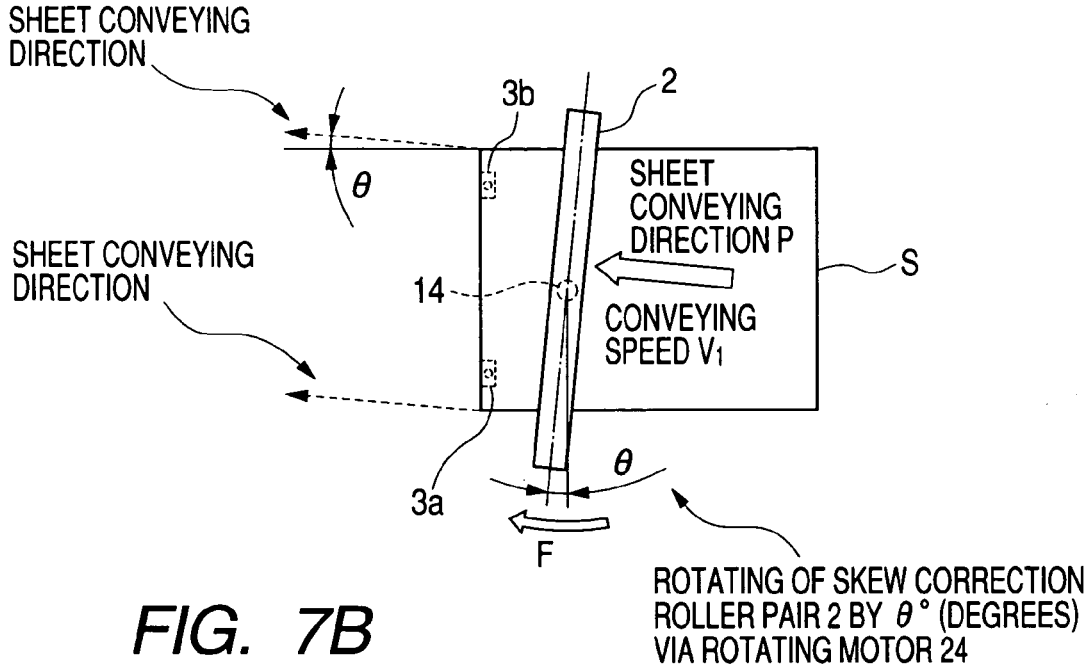
FIGS. 7A, 7B and 7C are second views illustrating the skew conveying correcting operation of the sheet conveying apparatus.

Then, the rotating motor 24 is driven (ON) for a predetermined time in conformity with the skew amount θ of the sheet S calculated in the above expression 1 (step 7). By the rotating motor 24 being thus driven for the predetermined time in conformity with the skew amount of the sheet S, the pair of skew correction rollers 2 are pivotally moved (turned) by θ in the direction of arrow F, i.e., a direction intersecting with the conveying direction, about the pivot shaft 14 until as shown in FIG. 7A, the leading edge of the sheet S nipped between the pair of skew correction rollers 2 becomes parallel to the axial direction of the transferring portion 112*b* (the axial direction of the photosensitive drum).

When the pair of skew correction rollers 2 are thus pivotally moved, the conveying direction of the sheet S conveyed by the pair of skew correction rollers 2 is also inclined by an angle θ as compared with the original direction. As the result, the entire sheet is fed in an oblique direction indicated by dot-and-dash line at the angle of inclination (hereinafter referred to as "skew feeding").

Figure 7B:
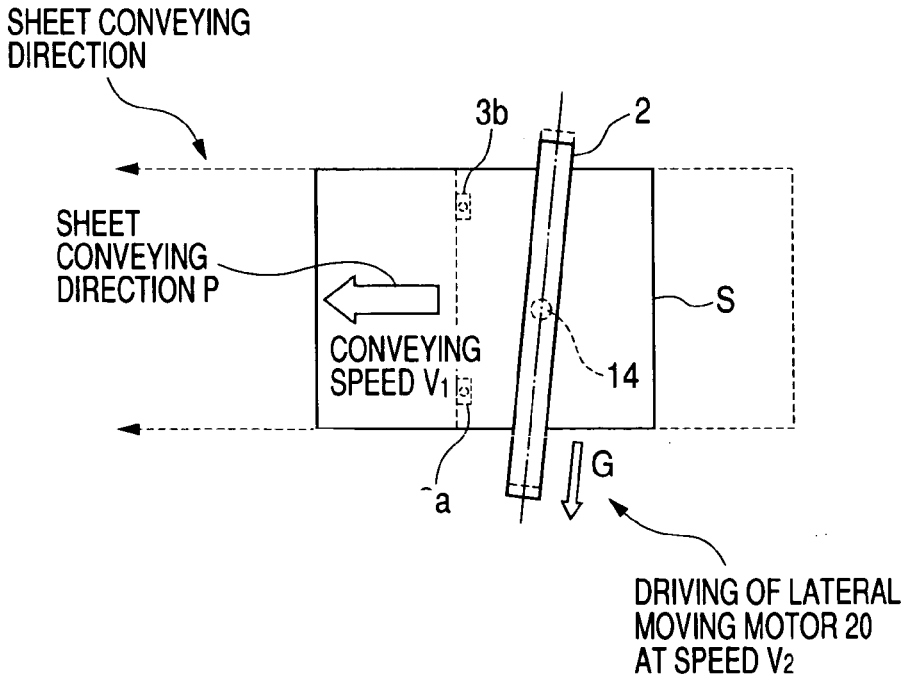

So, in the present embodiment, as already described, the pair of skew correction rollers 2 are rotatively moved by θ, whereafter the rotating motor 24 is rendered OFF (step 8), and thereafter the lateral moving motor 20 is driven so as to move the pair of skew correction rollers 2 in the direction of arrow G indicated in FIG. 7B.

Figure 7C:
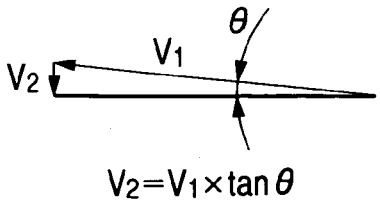

In this case, the sheet S is skew-fed by the pair of skew correction rollers 2 in a state skew by θ with respect to the transferring portion 112*b* and at the conveying speed V1 and therefore, in order that this skew-fed sheet S may be conveyed in the original sheet conveying direction, the movement speed V2 of the pair of skew correction rollers 2 in the thrust direction by the lateral moving motor 20 is, as shown in FIG. 7C, $$V2=V1\times\tan\theta \qquad \text{(expression 2)}$$

The speed of the lateral moving motor 20 for skew feeding correction is determined by this expression 2 (step 9), whereafter the lateral moving motor 20 is driven (ON) (step 10). Thereby, the skew feeding of the sheet S can be corrected and the sheet S can be conveyed in a direction coincident with the original sheet conveying direction.

Thereby, the skew conveying correction and skew feeding correction of the sheet S can be effected. If thereafter, the trailing edge of the sheet S has passed the pair of skew correction rollers 2 (Y at step 11), the lateral moving motor is stopped (OFF) (step 12).

By the correcting operation as described above being performed, the sheet S is fed out in an accurate conveying posture without being skew with respect to the transferring portion 112*b*, whereafter the toner image is transferred thereto. Thereafter, the operation of initializing the pair of skew correction rollers 2 is performed (step 13), and the pair of skew correction rollers 2 become ready for the correction of the skew conveying and skew feeding of the next sheet S. This initializing operation, as previously described, is performed on the basis of the signals from the first home position sensor 21 and the second home position sensor 25.

As described above, the skew of the sheet S is detected by the skew conveying detection sensors 3*a* and 3*b*, and in conformity with the skew amount, the pair of skew correction rollers 2 are pivotally moved, whereby and whereafter the pair of skew correction rollers 2 are moved in the thrust direction by the lateral moving motor 20 while the sheet S is conveyed, whereby it is possible to effect very smooth and accurate skew conveying correction and skew feeding correction without once stopping the sheet S.

That is, when as in the present embodiment, the pair of skew correction rollers 2 are pivotally moved (moved) in a direction to correct the skew of the sheet S, the lateral moving motor 20 is controlled so as to move the pair of skew correction rollers 2 at such a speed that the direction of the sheet S conveyed by the pair of skew correction rollers 2 coincides with the sheet conveying direction, whereby more accurate skew conveying correction and skew feeding correction can be accomplished.

A second embodiment of the present invention will now be described.

Figure 8:
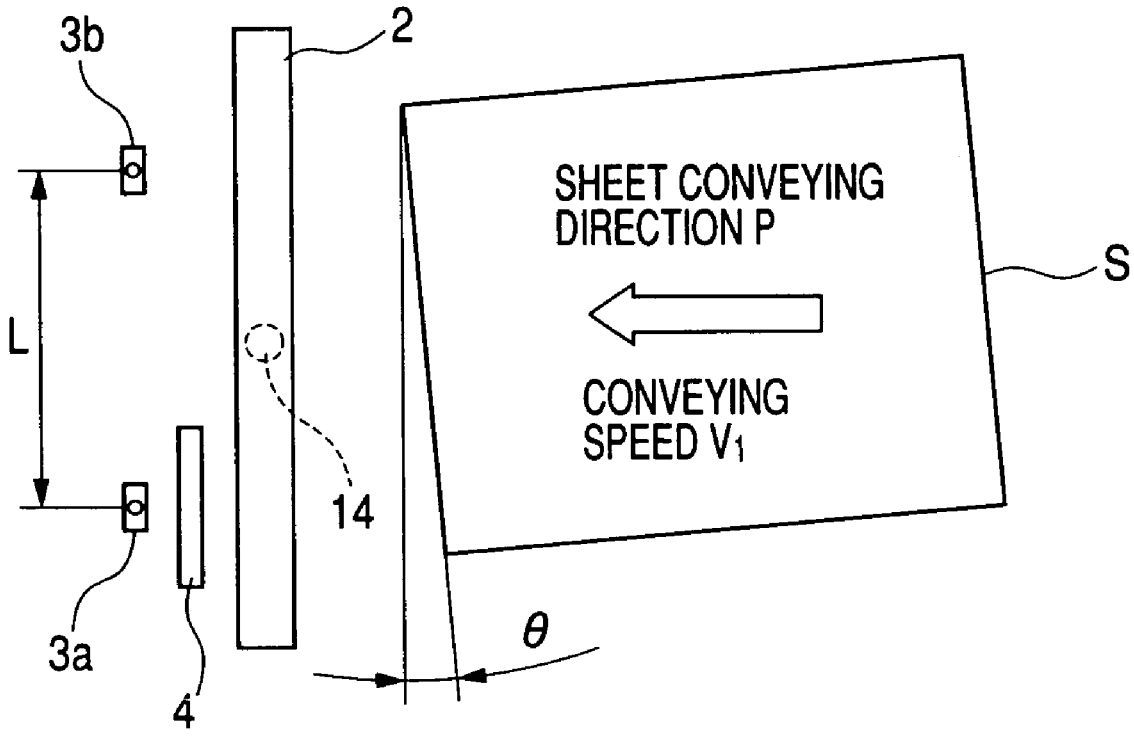
FIG. 8 is a plan view of the skew correction roller portion of a sheet conveying apparatus according to a second embodiment of the present invention.

FIG. 8 is a plan view of the skew correction roller portion of a sheet conveying apparatus according to the second embodiment. In FIG. 8, the same reference characters as those in FIG. 6 designate the same or corresponding portions.

In FIG. 8, the reference numeral 4 designates a sheet side edge position detection sensor which is position detecting means comprised of a CCD sensor or the like for detecting the position of the side edge of the sheet S in the thrust direction, and this sheet side edge position detection sensor 4 is disposed between the pair of skew correction rollers 2 and skew conveying detection sensors 3*a*, 3*b* for detecting the skew of the leading edge of the sheet S.

Figure 9:
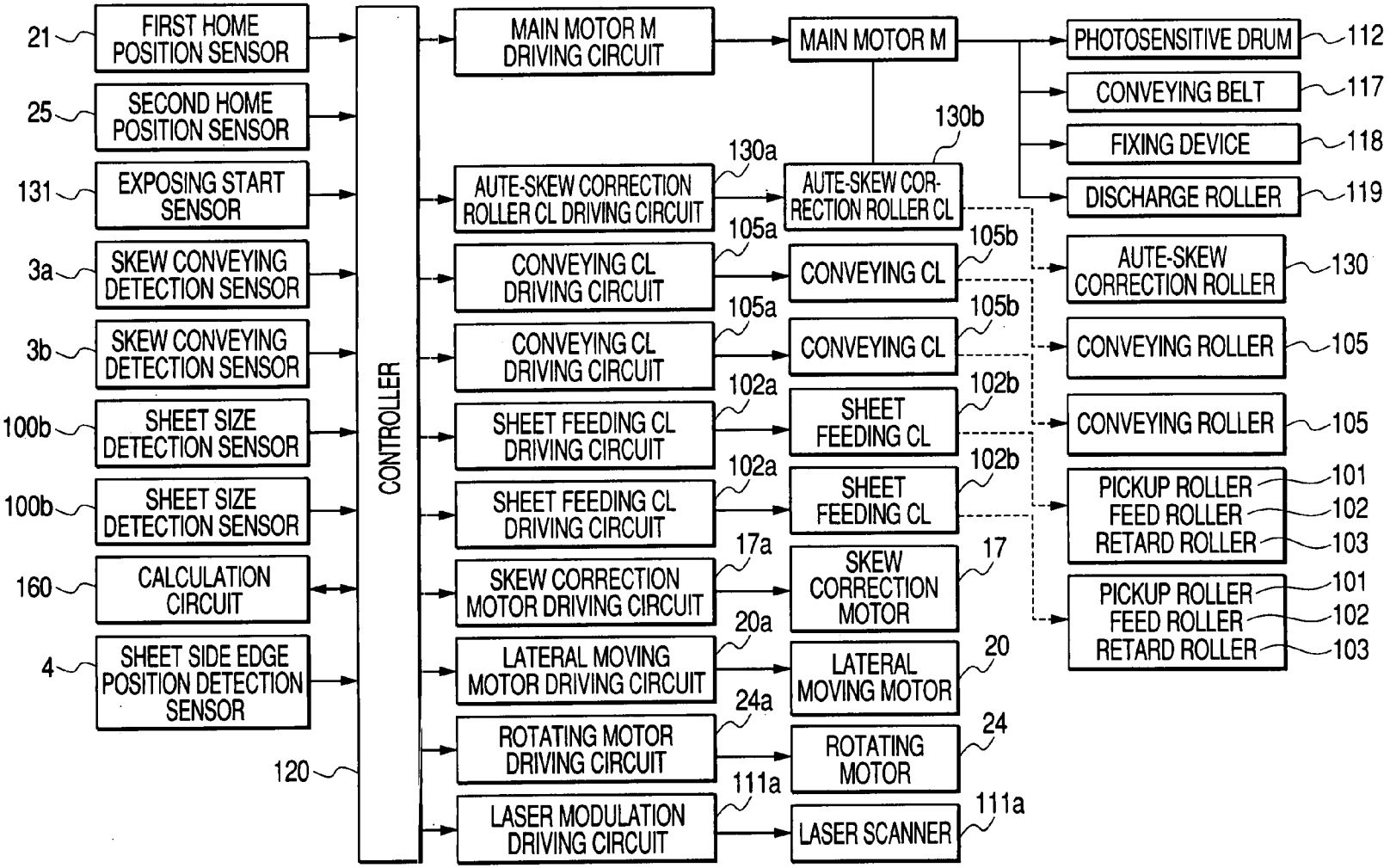
FIG. 9 is a control block diagram of a printer provided with the sheet conveying apparatus.
Figure 10:
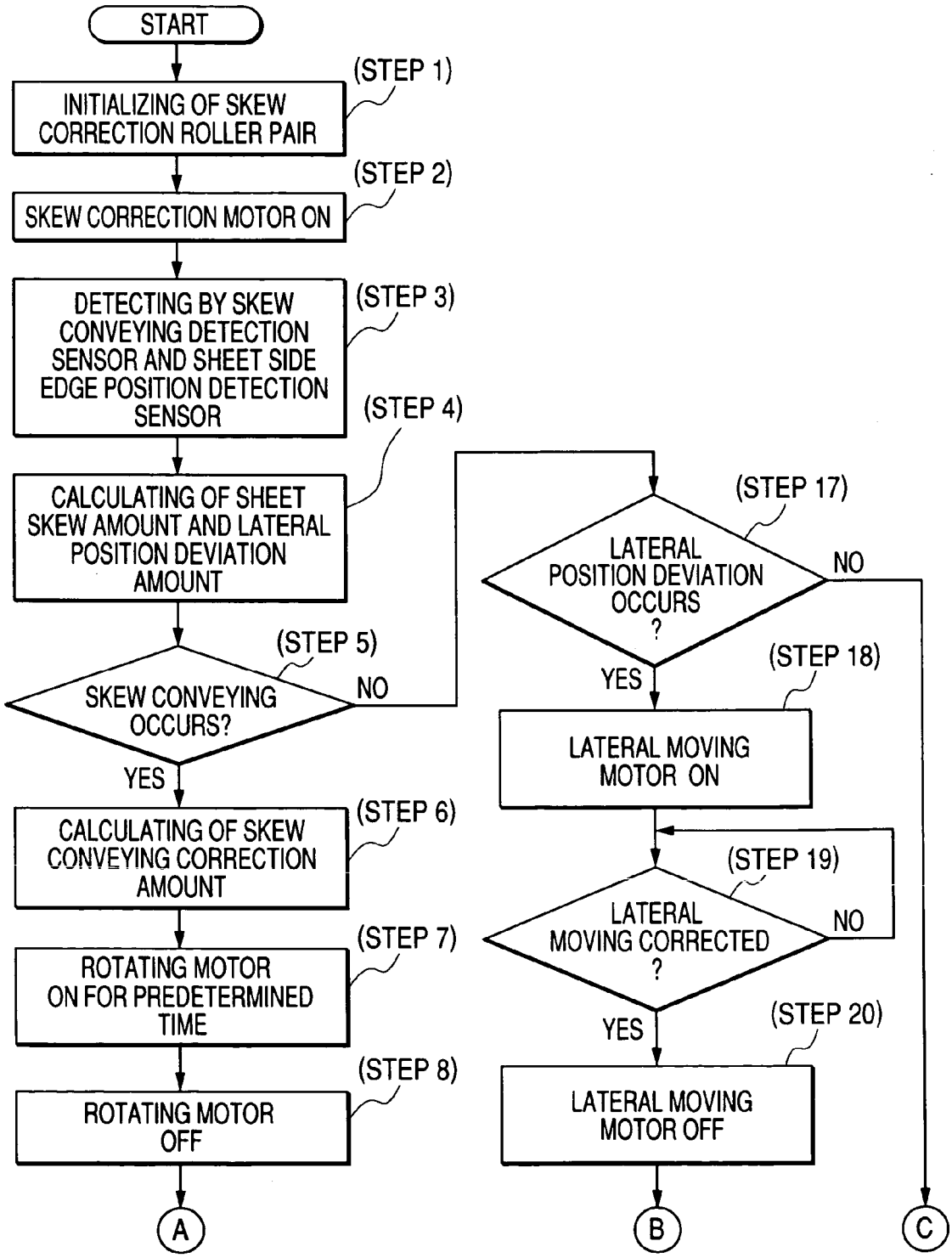
FIG. 10 is a part of a flow chart illustrating the skew conveying correcting operation of the sheet conveying apparatus.
Figure 11:
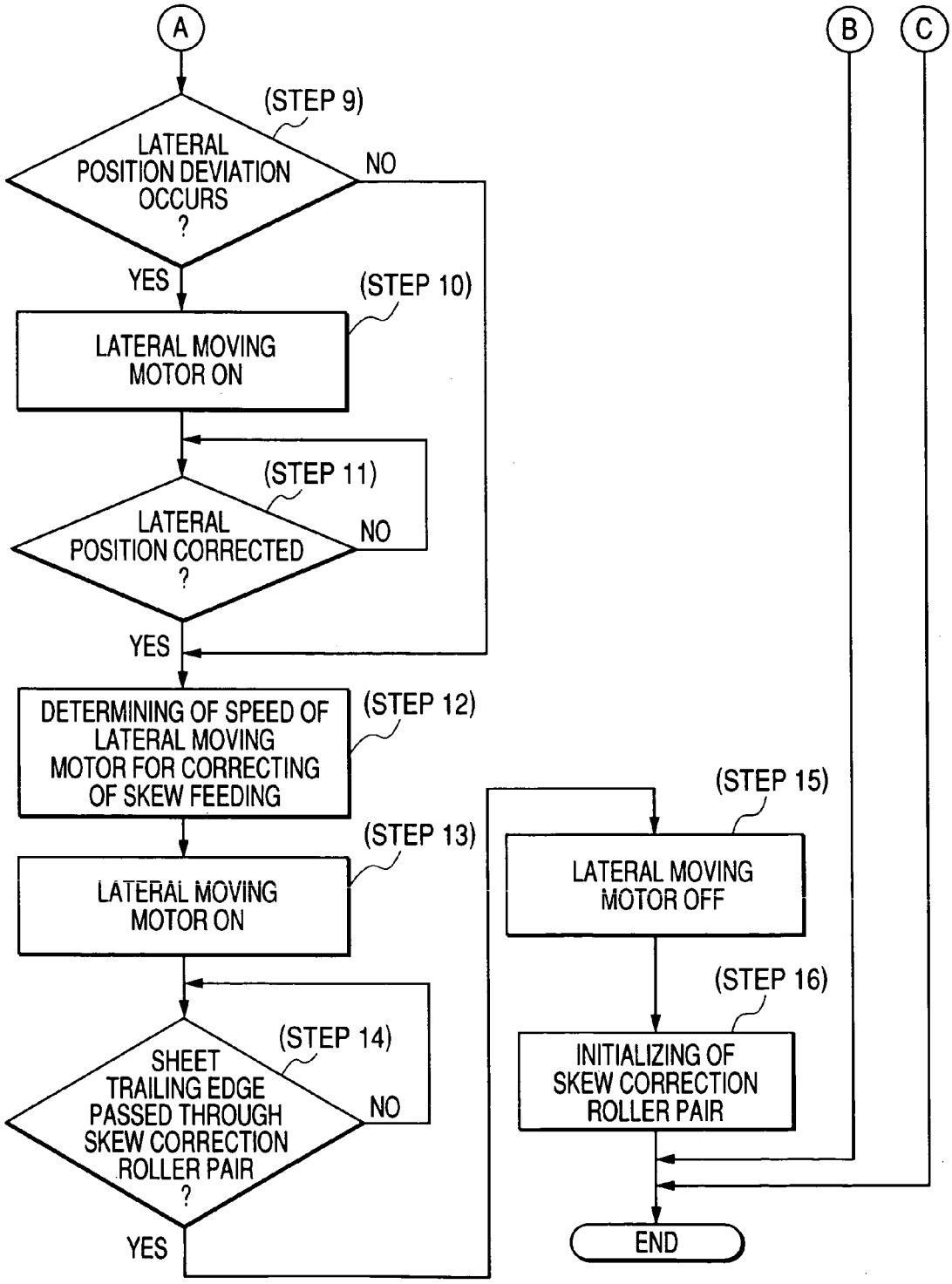
FIG. 11 is another part of the flow chart illustrating the skew conveying correcting operation of the sheet conveying apparatus.

FIG. 9 is a control block diagram of a printer 1000 provided with such a sheet conveying apparatus 1004, etc., and as shown in FIG. 9, the sheet side edge position detection sensor 4 is connected to a controller 120.

The skew amount of the sheet S is calculated by a calculating circuit 160 on the basis of detection signals from the skew conveying detection sensors 3*a* and 3*b* inputted to the controller 120, and the positional deviation amount of the sheet S in the thrust direction (hereinafter referred to as the lateral reference deviation amount) is calculated on the basis of the detection signal of the sheet side edge position detection sensor 4.

The skew conveying correcting operation of the printer 1000 (sheet conveying apparatus 1004) of such a construction will now be described with reference to the flow charts of FIGS. 10 and 11, and FIGS. 12A, 12B and 13.

When the start button, not shown, of the printer 1000 is first depressed, the lateral moving motor 20 and the rotating motor 24 are driven, and the operation of initializing the pair of skew correction rollers 2 is performed by the first home position sensor 21 and the second home position sensor 25 (step 1).

After this initializing operation, the skew correction motor 17 is driven (ON) and the pair of skew correction rollers 2 start to be rotated (step 2). Thereafter, the sheet S skew by θ with respect to the sheet conveying direction P is fed to the pair of skew correction rollers 2 which have started to be rotated (see FIG. 8), and this sheet S will soon come into and nipped by the nip portion of the pair of skew correction rollers 2 while remaining skew.

Figure 12A:
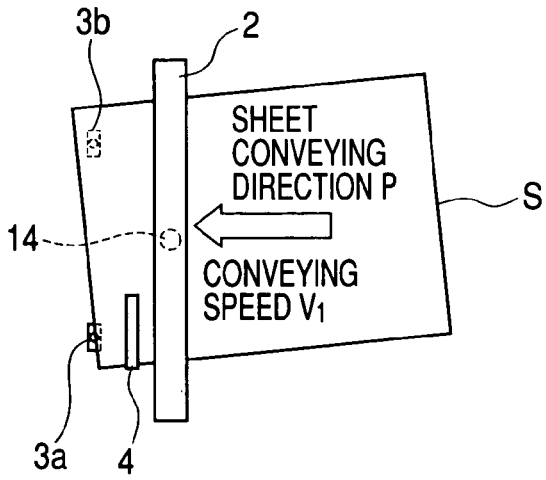
FIGS. 12A and 12B are first views illustrating the skew conveying correcting operation of the sheet conveying apparatus.

Thereafter, the sheet S nipped between the pair of skew correction rollers 2 is fed forward along the sheet conveying direction P, as shown in FIG. 12A, whereby the point of time at which the leading edge of the sheet passes is detected by the skew conveying detection sensors 3*a* and 3*b* disposed downstream of the pair of skew correction rollers 2 and the lateral reference deviation of the sheet S is detected by the sheet side edge position detection sensor 4 (step 3).

Detection signals from the skew conveying detection sensors 3*a*, 3*b* and the sheet side edge position detection sensor 4 are inputted to the controller 120, whereafter the skew amount of the sheet S nipped between the pair of skew correction rollers 2 and the lateral reference deviation amount of the sheet S are calculated by the calculating circuit 160 (step 4).

Next, the controller 120 first judges the presence or absence of the skew conveying of the sheet S from the result of this calculation (step 5), and if the skew conveying of the sheet S is absent (when θ=0)(N at the step 5), and next judges whether lateral reference deviation is present (step 17). If the lateral reference deviation is present (Y at step 17), the lateral moving motor 20 is driven (ON)(step 18). When thereafter, it is detected by the detection signal from the sheet side edge position detection sensor 4 that the lateral position has been corrected (Y at step 19), the lateral moving motor 20 is stopped (OFF)(step 20).

On the other hand, if the skew conveying of the sheet S is present (Y at step 5), a skew conveying correction amount therefor, i.e., the drive amount of the rotating motor 24, is calculated by the already mentioned expression 1 (step 6).

Thereafter, in conformity with the calculated skew amount θ of the sheet S, the rotating motor 24 is driven (ON) for a predetermined time (step 7). By the rotating motor 24 being thus driven for the predetermined time in conformity with the skew amount of the sheet S, the pair of skew correction rollers 2 are pivotally moved by θ in the direction of arrow F about the pivot shaft 14 until as shown in FIG. 12B, the leading edge of the sheet S nipped between the pair of skew correction rollers 2 becomes parallel to the axial direction of the transferring portion 112 (the axial direction of the photosensitive drum).

Next, after the rotating motor 24 has been driven for the predetermined time, it is stopped (OFF)(step 8), whereafter whether lateral reference deviation is present is judged (step 9). If the lateral reference deviation is absent (N at step 9), the correcting operation is not particularly performed, but if the lateral reference deviation is present (Y at step 9), the lateral moving motor 20 is driven (step 10).

Figure 13A:
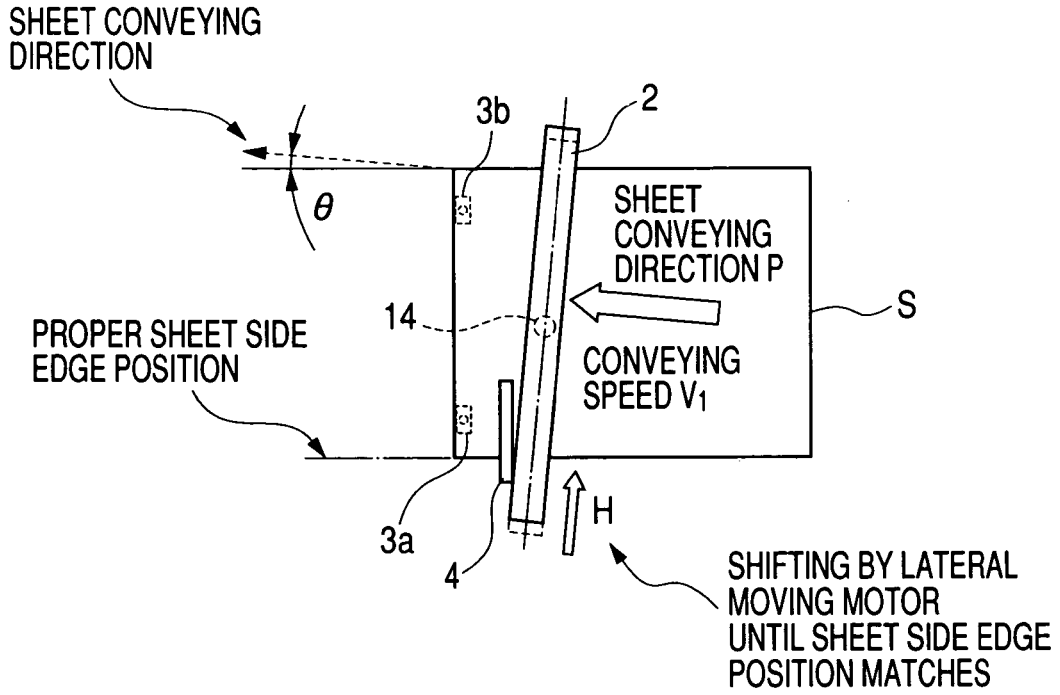
FIGS. 13A and 13B are second views illustrating the skew conveying correcting operation of the sheet conveying apparatus.

By the lateral moving motor 20 being thus driven, as shown in FIG. 13A, the position of the side edge (end) of the sheet is moved to a predetermined position and the lateral position is corrected, and when this is detected by the detection signal from the sheet side edge position detection sensor 4 (Y at step 11), the lateral moving motor 20 is stopped (OFF).

Figure 12B:
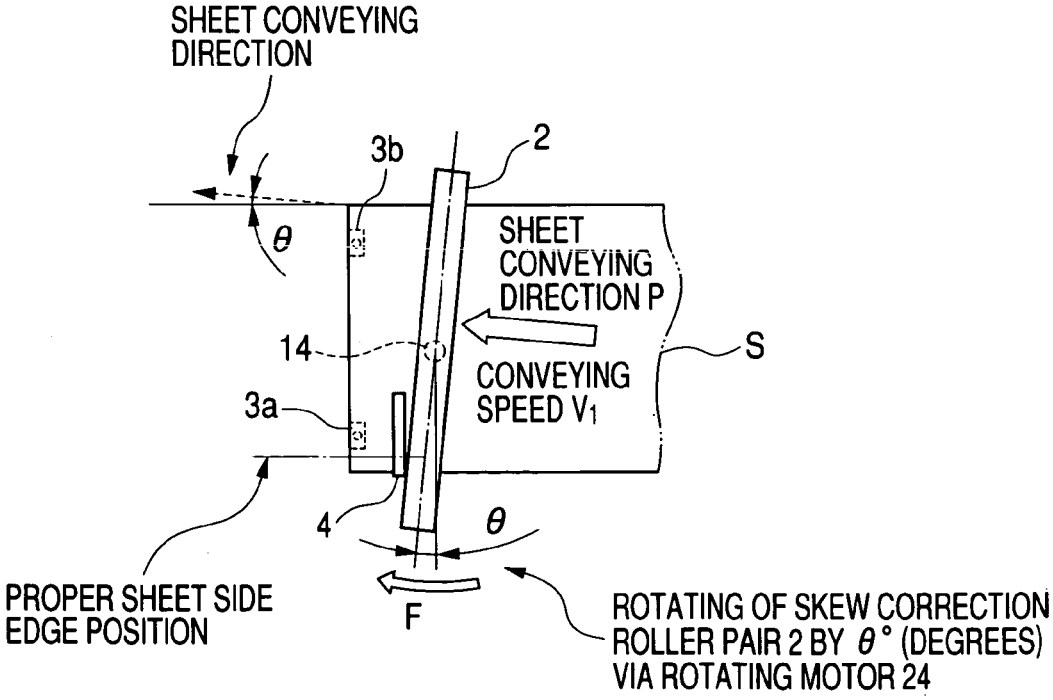

At this time, the leading edge of the sheet S nipped between the pair of skew correction rollers 2 is parallel to the axial direction of the transferring portion 112*b* (the axial direction of the photosensitive drum in the transferring portion), and the lateral position of the sheet S is also at a proper position, but as already described, when the pair of skew correction rollers 2 are pivotally moved, the conveying direction of the sheet S conveyed by the pair of skew correction rollers 2 is also inclined by the same angle θ as compared with the original direction, as shown in FIG. 12B already described, or FIG. 13A. As the result, the entire sheet is skew-fed at the angle θ of inclination in a direction indicated by dot-and-dash line.

Figure 13B:
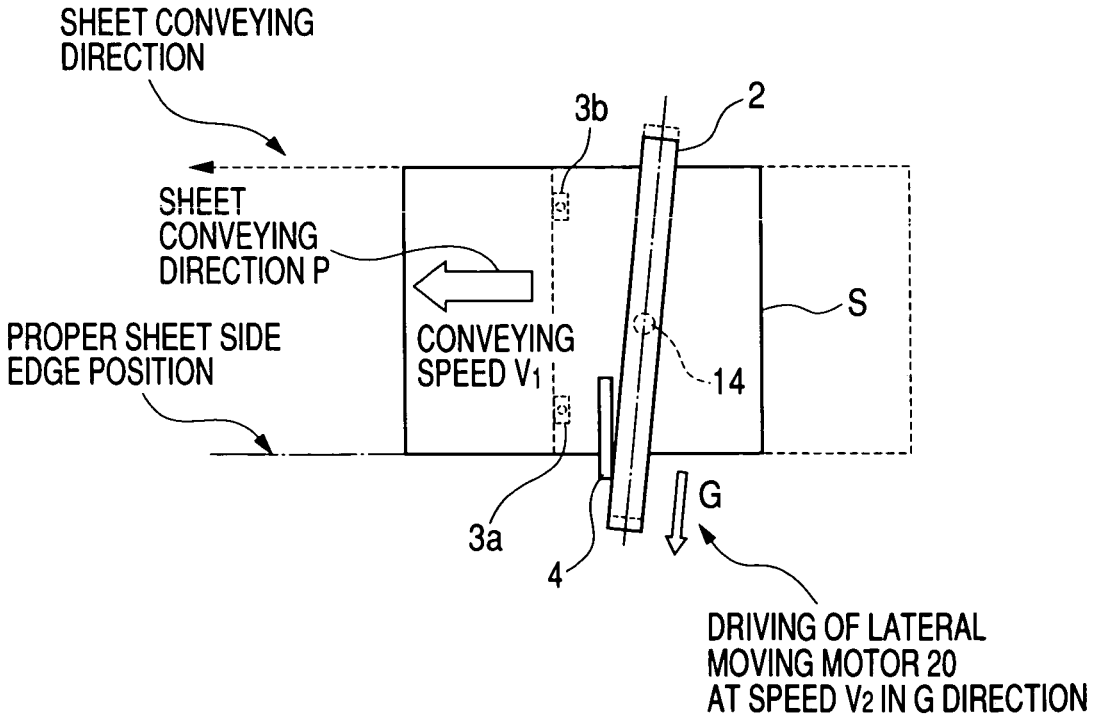

So, next, after the pair of skew correction rollers 2 are thus pivotally moved by θ, the speed of the lateral moving motor 20 for skew feeding correction is determined by the already mentioned expression 2 (step 12), whereafter the lateral moving motor 20 is driven (ON)(step 13), to thereby move the pair of skew correction rollers 2 in the direction of arrow G as shown in FIG. 13B. By the pair of skew correction rollers 2 being thus moved in the direction of arrow G, the skew feeding of the sheet can be corrected to thereby convey the sheet S in a direction coincident with the original sheet conveying direction. Thereby, the skew conveying correction and skew feeding correction of the sheet S can be accomplished.

Next, when the trailing edge of the sheet S passes the pair of skew correction rollers 2 (Y at step 14), the lateral moving motor 20 is stopped (OFF)(step 15).

By the correcting operation as described above being performed, the sheet S is fed out in an accurate conveying posture without being skew with respect to the transferring portion 112*b*, whereafter a toner image is transferred thereto. Thereafter, the operation of initializing the pair of skew correction rollers 2 is performed (step 16), and the pair of skew correction rollers 2 become ready for the correction of the skew conveying and skew feeding of the next sheet S. This initializing operation is performed on the basis of signals from the first home position sensor 21 and the second home position sensor 25, as previously described.

As described above, the skew of the sheet S is detected by the skew conveying detection sensors 3*a* and 3*b*, and in conformity with the skew amount, the pair of skew correction rollers 2 are inclined to thereby effect the skew feeding correction of the sheet S, whereafter the lateral reference deviation of the sheet S is corrected by the sheet side edge position detection sensor 4 and thereafter, the lateral moving motor 20 is controlled on the basis of information obtained by the skew conveying detection sensors 3, whereby skew feeding correction can also be accomplished.

By adopting such a construction, not only it is possible to effect very accurate skew conveying correction and skew feeding correction without once stopping the sheet S, but also the correction of the lateral reference deviation of the sheet becomes possible.

Now, in the present embodiment, as in the first embodiment, the lateral moving motor 20 is rotated during sheet conveyance on the basis of the detection signals from the skew conveying detection sensors 3*a* and 3*b* to thereby effect skew feeding correction, but skew feeding correction can be effected even if design is made such that without the use of the skew conveying detection sensors 3*a* and 3*b*, for example, the sheet side edge position detection sensor 4 is normally monitored, and the lateral moving motor 20 is rotated when the positional deviation or a change in the positional deviation amount of the sheet side edge is detected by the sheet side edge position detection means 4.

Figure 14A:
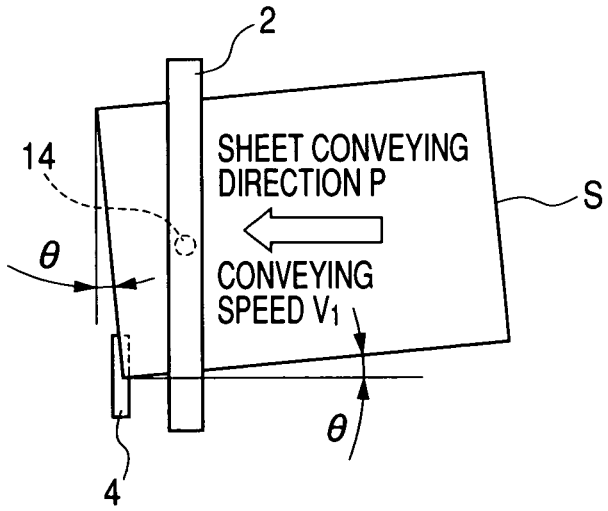
FIGS. 14A, 14B and 14C are plan views of the skew correction roller portion of a sheet conveying apparatus according to a third embodiment of the present invention.
Figure 14B:
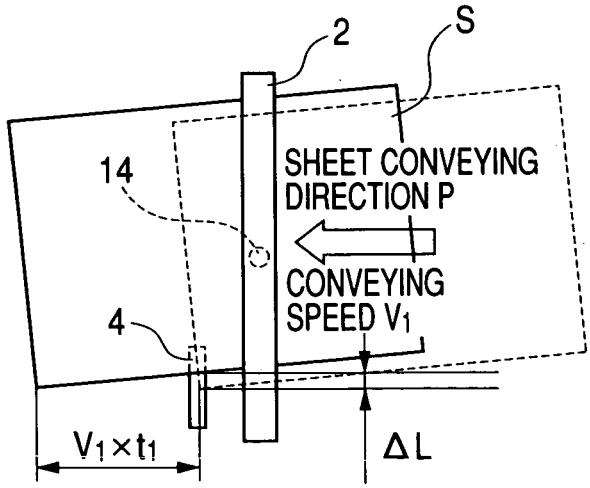
Figure 14C:
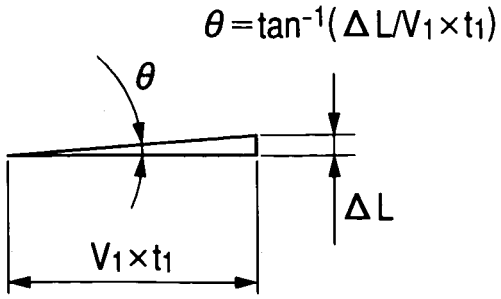

FIGS. 14A, 14B and 14C are plan views of the skew correction roller portion of a sheet conveying apparatus according to such a third embodiment of the present invention. In these figures, the same reference characters as those in FIG. 8 designate the same or corresponding portions.

In the present embodiment, the controller 120 is designed to find a change in the side edge position of the sheet S by a position detection signal from the sheet side edge position detection sensor 4, and a position detection signal inputted after a predetermined time t1 has elapsed after this position detection signal has been inputted, and detect the skew of the sheet, i.e., the skew feeding of the sheet S, from this change in the sheet side edge position, and perform a skew feeding correcting operation on the basis of this detected information.

Description will now be made of the skew feeding correcting operation in the present embodiment.

When as shown in FIG. 14A, a sheet S skew by θ with respect to the sheet conveying direction is fed, and the sheet S comes into and is nipped by the nip portion of the pair of skew correction rollers 2, this sheet is thereafter fed forward along the sheet conveying direction P. The point of time at which the leading edge of the sheet passes the nip portion is detected by the sheet side edge position detection sensor 4 disposed downstream of the pair of skew correction rollers 2 and the first positional deviation in the thrust direction is detected by the sheet side edge position detection sensor 4.

Then, as shown in FIG. 14B, a predetermined time after, the value of the sheet side edge position detection sensor 4 is again read, and when the difference between these two (plural) position detection signals from the sheet side edge position detection sensor 4 is ΔL, assuming that the sheet conveying speed is V1, the skew amount θ of the sheet can be calculated by the following expression 3 as is apparent from FIG. 14C.

$$\theta=\tan^{-1}(\Delta L/(V1\times t1)) \quad \text{(expression 3)}$$

Not only the positional deviation amount of the sheet S, but also the skew amount θ of the sheet can be thus detected by the sheet side edge detection sensor 4 and therefore, if thereafter, control similar to that in the already described second embodiment is effected, it becomes possible to effect skew conveying correction, lateral position correction and skew feeding correction by the sheet side edge position detection sensor 4 alone.

That is, by adopting a construction like that of the present embodiment, it is possible to detect both of the skew amount of the sheet S and the thrust position deviation of the sheet S by the sheet side edge position detection sensor 4 alone, whereby it is possible to effect skew conveying correction, lateral position correction and skew feeding correction accurately by a very simple construction.

Further, in the hitherto described first and second embodiments, it never happens that as in the loop registration method, the sheet is once stopped at the skew correction roller portion to thereby form a loop and therefore, not only it is possible to minimize the inter-sheet spacing and an apparatus of high productivity can be provided, but also there is no production of a loop sound and the problem of buckling during the formation of a loop of thin paper can also be solved.

Also, of course, the loop space becomes unnecessary and the downsizing of the apparatus is possible. Further, even if due to the deformation of the leading edge portion of the sheet S such as the curl or breakage of the leading edge portion, the sheet S comes to be nipped between the pair of skew correction rollers 2 in a posture differing from that before it is nipped, the skew conveying and skew feeding of the sheet S can be accurately corrected without being affected by it.

Now, while in the description hitherto made, a case where as already described, the sheet conveying means is used in an image forming apparatus so as to be capable of accurately feeding out the sheet S to the image forming portion 1003 without skew or positional deviation has been described, the present invention is not restricted thereto, but can also be applied, for example, to an image reading apparatus so as to be capable of accurately feeding out the sheet S to an image reading portion for reading a sheet (original) which is a post-step, without skew or positional deviation.

What is claimed is:

1. An image forming apparatus having an image forming portion for forming an image on a sheet and a sheet conveying apparatus for conveying the sheet to the image forming portion, said image forming apparatus comprising:

a skew detecting sensor configured to detect the skew of the sheet being conveyed with respect to a sheet conveying direction;

a skew correcting mechanism rotatable in a direction to correct the skew of the sheet in a state nipping the sheet in its skew state;

a position correcting mechanism configured to move said skew correcting mechanism in a direction intersecting with the sheet conveying direction; and a controller configured to control so as to rotate said skew correcting mechanism on the basis of a detection signal from said skew detecting sensor and to move said skew correcting mechanism in the direction intersecting with the sheet conveying direction by said position correcting mechanism while correcting the skew of the sheet by said skew correcting mechanism, wherein when an angle by which said skew correcting mechanism is rotated to correct the skew of the sheet is defined as θ, and a speed at which said skew correcting mechanism conveys the sheet in the rotated state is defined as V1, said controller controls so that a speed V2 at which said position correcting mechanism is moved in the direction intersecting with the sheet conveying direction may satisfy an expression that $$V2=V1\times\tan\theta.$$

2. An image forming apparatus according to claim 1, wherein said controller controls said position correcting mechanism to move said skew correcting mechanism in the direction intersecting with the sheet conveying direction in order to convey the sheet in a state coincident with the sheet conveying direction when said skew correcting mechanism is rotated to correct the skew of the sheet.

3. An image forming apparatus according to claim 1, further comprising a position detecting sensor configured to detect the position of a side edge of the sheet conveyed to said sheet conveying path in a direction orthogonal to the sheet conveying direction, and wherein said controller controls on the basis of a detection signal from said position detecting sensor so as to move said skew correcting mechanism in the direction intersecting with the sheet conveying direction by said position correcting mechanism so that the position of the side edge of the sheet may become a predetermined position.

4. An image forming apparatus having an image forming portion for forming an image on a sheet and a sheet conveying apparatus for conveying the sheet to the image forming portion, said image forming apparatus comprising:

a position detecting sensor configured to detect the position of a side edge of the sheet conveyed along the sheet conveying path in a direction orthogonal to a sheet conveying direction;

a skew correcting mechanism rotatable in a direction to correct the skew of the sheet;

a position correcting said skew correcting mechanism in a direction intersecting with the sheet conveying direction; and a controller configured to control so as to rotate said skew correcting mechanism on the basis of a detection signal from said position detecting sensor and to move said skew correcting mechanism in the direction intersecting with the sheet conveying direction by said position correcting mechanism on the basis of side edge position information from said position detecting sensor so that the position of the side edge of the sheet may become a predetermined position, and subsequently to move said skew correcting mechanism in the direction intersecting with the sheet conveying direction by said position correcting mechanism while correcting the skew of the sheet by said skew correcting mechanism, so the sheet is conveyed so that the side edge of the sheet is coincident with the predetermined position, wherein when an angle by which said skew correcting mechanism is rotated to correct the skew of the sheet is defined as θ, and a speed at which said skew correcting mechanism conveys the sheet in the rotated state is defined as V1, said controller controls so that a speed V2 at which said position correcting mechanism is moved in the direction intersecting with the sheet conveying direction may satisfy an expression that $$V2=V1\times\tan\theta.$$

5. An image forming apparatus according to claim 4, wherein said controller controls said position correcting mechanism to move said skew correcting mechanism in the direction intersecting with the sheet conveying direction in order to convey the sheet in a state coincident with the sheet conveying direction when said skew correcting mechanism is rotated to correct the skew of the sheet.

6. An image forming apparatus according to claim 4, further comprising calculating means for calculating the skew of the sheet on the basis of side edge position information from said sheet side edge position detection sensor, wherein the skew correcting mechanism is rotated on the basis of a result of calculation from said calculating means.

7. An image forming apparatus according to claim 6, wherein said calculating means finds a change in the side edge position of said sheet on the basis of side edge position information from said position detecting sensor, and calculates the skew of said sheet from this change in the side edge position of the sheet.

* * * * *

UNITED STATES PATENT AND TRADEMARK OFFICE

CERTIFICATE OF CORRECTION

PATENT NO. : 7,300,054 B2
APPLICATION NO. : 10/893349
DATED : November 27, 2007
INVENTOR(S) : Suga et al.

It is certified that error appears in the above-identified patent and that said Letters Patent is hereby corrected as shown below:

ON THE TITLE PAGE:
At Item (56), References Cited, Foreign Patent Document, "2005035709" should read --2005-035709--.

IN THE DRAWINGS:
Sheet No. 4, Figure 4, "AUTE-SKEW" (all occurrences) should read --ANTE-SKEW--.
Sheet No. 9, Figure 9, "AUTE-SKEW" (all occurrences) should read --ANTE-SKEW--.

Signed and Sealed this

First Day of July, 2008

JON W. DUDAS
*Director of the United States Patent and Trademark Office*